United States Patent [19]

Holland

[11] 4,362,984

[45] Dec. 7, 1982

[54] CIRCUIT TO CORRECT NON-LINEAR TERMS IN BANDGAP VOLTAGE REFERENCES

[75] Inventor: Varnum S. Holland, Richardson, Tex.

[73] Assignee: Texas Instruments Incorporated, Dallas, Tex.

[21] Appl. No.: 244,356

[22] Filed: Mar. 16, 1981

[51] Int. Cl.[3] ..... G05F 3/20

[52] U.S. Cl. ..... 323/313; 323/907

[58] Field of Search ..... 307/297; 323/313, 314, 323/907, 312, 316

[56] References Cited

U.S. PATENT DOCUMENTS

| | | | |
|---|---|---|---|
| 3,794,861 | 2/1974 | Bernacchi | 307/297 |
| 4,032,839 | 6/1977 | Ahmed | 323/316 |
| 4,079,308 | 3/1978 | Brown | 323/314 |
| 4,103,249 | 7/1978 | Burdick | 307/297 X |
| 4,250,445 | 2/1981 | Brokaw | 323/907 X |
| 4,325,018 | 4/1982 | Schade, Jr. | 323/316 X |

OTHER PUBLICATIONS

Widlar, Robert J., "Low Voltage Techniques", IEEE International Solid State Circuits Conference, Feb. 17, 1978.

Tsividis, Yannis P., "Accurate Analysis of Temperature Effects in $I_c$–$V_{BE}$ Characteristics with Application to Bandgap Reference Sources", IEEE Journal of Solid State Circuits, vol. SC-15, No. 6, Dec. 1980.

Brokaw, A. P., "A Simple Three Terminal IC Bandgap Reference", IEEE Journal of Solid State Circuits, vol. SC-9, No. 6, Dec. 1974.

*Primary Examiner*—William M. Shoop

*Attorney, Agent, or Firm*—Mel Sharp; Richard L. Donaldson; Douglas A. Lashmit

[57] ABSTRACT

A circuit and a method of operation thereof are disclosed to compensate for second order non-linearities in bandgap voltage references. The circuit is readily fabricated as an integrated circuit in conjunction with circuitry utilized to correct linear variations. The circuit accurately compensates for the non-linear bow effect over a temperature range of −55° C. to +150° C.

7 Claims, 2 Drawing Figures

CIRCUIT TO CORRECT NON-LINEAR TERMS IN BANDGAP VOLTAGE REFERENCES

BACKGROUND OF THE INVENTION

Reference voltages have a broad appliability to several aspects of solid state electronics. Voltage regulators, analog-to-digital converters and digital-to-analog converters are some examples which require high precision reference voltages for optimum operation.

One problem has been observed in that the output of a reference will tend to vary with changing temperature. This has been attributed to the physical properties of the components used. This temperature variation has a linear component as well as a non-linear component. For example, see the Robert J. Widlar article entitled "Low Voltage Techniques" presented Feb. 17, 1978 at the I.E.E.E. International Solid State Circuits Conference.

Accordingly, it is an object of the present invention to provide a circuit which compensates for the non-linear temperature caused variation in a reference voltage.

It is a further object of the present invention to provide a circuit readily fabricated in a conventional integrated circuit manner which will compensate for non-linear as well as linear variations caused by temperature fluctuations.

SUMMARY AND BRIEF DESCRIPTION OF THE INVENTION

Briefly in accordance with the present invention, a circuit is disclosed which compensates for non-linear temperature induced variation in a reference voltage. Two currents are maintained at a similar magnitude and directed through a pair of current gain devices, normally transistors. A component of one of the currents is directed through a third gain device. The gain of the third device is controlled by a fourth device or set of devices such that the component of current varies as a function of temperature of the fourth set of devices.

the function is selected such that the first and second transistors, together with the associated resistors, compensate for linear fluctuation in the output of the voltage reference caused by temperature variations. The third and fourth transistors operate only on the current component to provide a compensating function for the non-linear second order effects of temperature variation.

Other novel features, objects and advantages of the invention will be apparent upon reading the following detailed description of illustrative embodiments of the invention in conjunction with the drawings herein.

DETAILED DESCRIPTION OF THE DRAWINGS

Figure 1A:
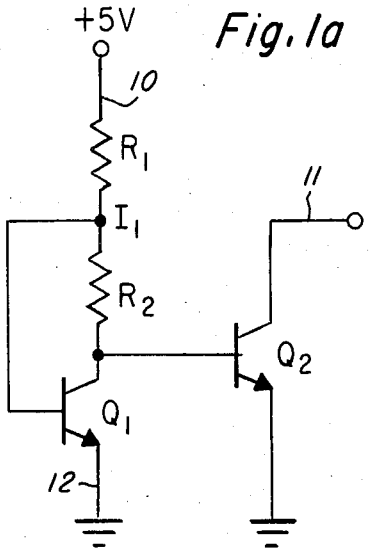

The novel featurs believed to be characteristic of this invention are set forth in the appended claims. The invention itself, however, as well as other objects and advantages thereof may best be understood by reference to the following detailed description of illustrative embodiments when read in conjunction with the accompanying drawings in which:

FIG. 1*a* represents a circuit diagram of the present invention isolated from associated circuitry.

Figure 1B:
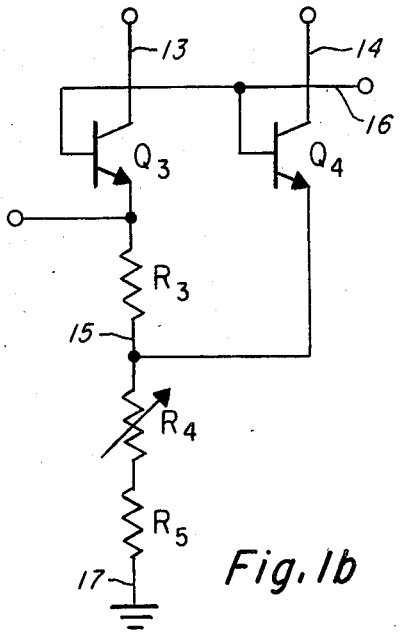

FIG. 1*b* represents a typical linear variation compensation circit without circuit means for non-linear compensation.

Referring now to FIG. 1*a*, transistor $Q_1$ is a set of four transistors operated in parallel. Four transistors were found experimentally to have the proper amount of temperature responsivity when the base was connected to the voltage divider circuit shown by $R_1$ and $R_2$. The number of transistors, and the values for $R_1$ and $R_2$ are governed by formulas disclosed herein. In the preferred embodiment, $R_1$ is 4.96 KΩ and $R_2$ is 178Ω. The junction ratio between $Q_1$ and $Q_2$ is 4 to 1 which results in smaller resistance values for $R_1$ and $R_2$ and thus less area on the chip.

The background of the mathematical derivation of the required formulas is contained in the article by Yannis P. Tsividis entitled "Accurate Analysis of Temperature Effects in $I_c-V_{BE}$ Characteristics With Application to Bandgap Reference Sources," published in the I.E.E.E. Journal of Solid State Circuits, Vol. SC-15, No. 6, December, 1980, which is incorporated herein by reference.

The approach in the preferred embodiment requires a derivation for the temperature variated current at point 11, in FIG. 1*a*. By appropriate control of that current with $Q_2$, a non-linear current component is subtracted which corresponds very closely with the observed non-linear variation caused by temperature fluctuation in a circuit such as shown in FIG. 1*b*. By deriving the temperature equation for the current at point 11, the formula $$I_2=(I_2/A)\,(e^{-I_1R_2q/kt})$$

is obtained where $I_1$ is the power supply voltage minus $V_{be}$ divided by $R_1$, q is the electronic charge in coulombs, k is Boltzmann's constant and t is the temperature in degrees kelvin. Thus the base-emitter junction area ratio, $A_{Q1}/A_{Q2}$ and $R_1$ can be calculated such that a current $I_2$ causes an offsetting effect upon the linear portion of the compensating circuitry.

The current through transistor $Q_1$ is thus selected by appropriate values for $R_1$. The base-emitter area ratio and $R_2$ are selected to obtain the closest degree of non-linear temperature compensation. It should be noted that the non-linear current component at 11 is relatively slight in magnitude with respect to the currents experienced in the circuitry shown in FIG. 1*b*.

The circuit shown in FIG. 1*b* produces an output voltage at 16 of approximately 1.248 volts at −50° C. and +150° C., and 1.254 volts at 40° C. when not corrected with the invented circuit, or a non-linear variation of approximately 6 mV over the temperature range. An article by A. P. Brokaw describing a typical bandgap reference is incorporated herein by reference entitled "A Simple Three Terminal IC Bandgap Reference," published in the I.E.E.E. Journal of Solid State Circuits, Vol. SC-9, No. 6, December, 1974. The circuit in FIG. 1*b* is designed in close conformity with the Brokaw device but results in a significant non-linear variation. With correction, however, the variation is from 1.2163 volts to 1.2172 volts over the temperature range for a difference of approximately 0.9 mV. This variation is considerably less and thus enables a much more stable reference voltage to be maintained. Due to the amplification effects in a 5 volt regulator circuit, for example, a variation of 27 mVolts is reduced to 3.2 millivolts at the output.

Referring now to FIG. 1*b*, resistor $R_4$ is adjusted at the slice probe stage for precise linear compensation by a zener diode burnout process which leaves the resistance required unshorted, and shorts the remaining resistances such that an accurate linear compensatin is obtained. Any similar adjustment procedure will also work, however, the variations in processing and materials require at least a minimum of adjustment so that the effect of the invented circuitry is not overwhelmed by the inaccurate compensating effects of transistors $Q_3$ and $Q_4$.

In actual design, the invented circuit, shown in FIG. 1*a*, is connected at point 11 to the circuit in FIG. 1*b* between $Q_3$ and $R_3$. Transistors $Q_3$ and $Q_4$ are interconnected in a manner in accordance with the Brokaw article, as well as the selection of $R_3$, $R_4$, $R_5$ and A, such that the output voltage at 16 is compensated for linear variation. The connection of the invented circuitry between $Q_3$ and $R_3$ results in a relatively small component of current being removed from the circuitry in FIG. 1*b* such that the combined circuitry results in both a linear and a non-linear compensated output.

While the principles of this invention have been described in connection with a specific circuit, it is to be understood that this description is made only by way of example and not as a limitation to the scope of the invention. The disclosed invention may also be used in applications other than voltage references to compensate for non-linear variations caused by temperature fluctuations. Numerous other circuits using this invention may be devised by those skilled in the art without departing from the spirit and scope of the appended claims.

What is claimed is:

1. A circuit which compensates for non-linear temperature induced variation in a voltage reference comprising:

a. means for directing first and second current to flow through first and second circuit means, respectively;

b. means for maintaining said first and second currents at a substantially similar magnitude;

c. means for directing a component of said first current to flow through a third circuit means; and d. means for controlling said third circuit means including fourth circuit means operable to increase or decrease the value of said current component as a function of temperature.

2. A circuit as in claim 1 wherein said first and second circuit means comprise a linear temperature variation compensation structure, and said third and fourth circuit means comprise a non-linear temperature variation compensation structure.

3. A circuit as in claim 2 wherein all of the above stated circuit means are integrated upon a single substrate.

4. A method for compensating for non-linear temperature induced variation in a voltage reference comprising the steps of:

a. directing first and second currents to flow through first and second circuit means, respectively;

b. maintaining said first and second currents at a substantially similar magnitude;

c. directing a component of said first current to flow through a third circuit means; and d. controlling said third circuit means with a fourth circuit means operable to increase or decrease the value of said current as a function of temperature.

5. A method as in claim 4 wherein the steps of directing and maintaing said first and second currents are operable to compensate for linear temperature variations and the steps of directing a component and controlling are operable to compensate for non-linear temperature variations.

6. A method as in claim 5 further including the step of integrating all of said circuit means upon a single substrate.

7. A voltage reference circuit wherein first circuit means are coupled to an input current means, said first circuit means operable to produce a voltage output compensated with respect to temperature induced linear variation, said voltage reference circuit characterized in that a second circuit means is included to compensate said voltage output with respect to temperature induced non-linear variation.

* * * * *